US006199926B1

(12) United States Patent
Lemoine

(10) Patent No.: US 6,199,926 B1
(45) Date of Patent: Mar. 13, 2001

(54) DISPENSER AND RETRIEVER FOR GOLF BALLS

(76) Inventor: Louis Joesph Lemoine, 6 Mead Ave., Mt. Sinai, NY (US) 11766

( * ) Notice: Subject to any disclaimer, the term of this patent is extended or adjusted under 35 U.S.C. 154(b) by 0 days.

(21) Appl. No.: 09/283,797

(22) Filed: Apr. 1, 1999

(51) Int. Cl.[7] ..... A63B 47/02; A63B 69/36

(52) U.S. Cl. ..... 294/19.2; 473/132; 221/310

(58) Field of Search ..... 294/19.2; 473/132, 473/134, 135, 136, 137; 206/315.9; 221/191, 194, 289, 310

(56) References Cited

U.S. PATENT DOCUMENTS 1,868,261 * 7/1932 Spencer ..... 473/134
1,937,180 * 11/1933 Young ..... 473/137
3,127,177 * 3/1964 Benkoe ..... 473/137
4,253,668 * 3/1981 Ose ..... 294/19.2
4,575,092 * 3/1986 Watson ..... 473/137
4,676,397 * 6/1987 Hoffmeister ..... 294/19.2
5,335,953 * 8/1994 Luther, Sr. ..... 294/19.2
5,624,325 * 4/1997 Smith ..... 473/137

* cited by examiner

*Primary Examiner*—Dean J. Kramer

(57) ABSTRACT

A dispenser and retriever for golf balls. The dispenser includes a leg, a foot, ball-dispensing apparatus, and ball-retrieving apparatus. The leg is hollow and holds the golf balls and is generally inclined relative to the ground so as to allow the golf balls to be biased downwardly therein. The foot is hollow and communicates with the leg and dispenses the golf balls held in the leg and is inclined relative to the leg to lie substantially flat on the ground so as to allow the golf balls to exit therefrom, onto the ground. The ball-dispensing apparatus is operatively connected to the foot and selectively dispenses the golf balls, one at a time, from the foot, by use of a golf club, and without use of a foot of a user and without the user having to bend down. The ball-retrieving apparatus is operatively connected to the leg and selectively picks up the golf balls already on the ground.

26 Claims, 3 Drawing Sheets

DISPENSER AND RETRIEVER FOR GOLF BALLS

BACKGROUND OF THE INVENTION

1. Field of the Invention

The present invention relates to a dispenser for golf balls. More particularly, the present invention relates to a dispenser and retriever for golf balls.

2. Description of the Prior Art

In many sporting games, it is commonly advantageous to practice repetitiously to improve one's game. The game of golf is no exception, and there have been many apparatus which are used to assist the golfer in improving the golfer's performance.

In the game of golf, an important aspect of the game is having an accurate putting stroke. It is advantageous when the golfer is practicing the putting stroke to repeatedly take many strokes hitting a ball and practicing the proper swing. Typically, the golfer practices by placing a plurality of golf balls on a putting green, which are repeatedly hit with a putter into holes positioned on the putting green, or on an artificial practice putting surface.

Typically, the golfer will take a handful of golf balls, such as six or seven, and place them all down on a putting surface. The golfer then putts them as a set attempting to sink them into each hole. At each hole, the golfer typically drops the balls onto the putting surface, and arranges them on the putting surface using the club head of the putter. The golfer then putts balls one at a time towards the hole. Eventually, all of the balls of the set have been hit toward and hopefully into the hole. The balls may then be removed from the hole.

Many putting greens include a retrieving cup connected to the end of a metal flag placed in the hole which can be used by the golfer to lift the balls out of the hole and place them again on the putting surface. Typically, the retrieving cup pulls the balls out of the hole and the balls spill from the cup onto the putting surface.

It is usually difficult, however, to use the retrieving cup to effectively pick the balls up off the ground. Thus, the golfer must arrange the golf balls on the putting surface either by gathering them together using the putter club head as a guide to move the golf balls into the desired position, or the golfer must bend over and reach down to place the golf balls as desired by hand.

In addition, if it is desired to start putting a set of balls from a different location, usually the golfer must bend over and individually pick up all of the balls and carry them to the new starting point for the next round of practice strokes using that set of golf balls. Also, for individual putts, the golfer must bend down to pick up the ball.

Numerous innovations for ball dispensers have been provided in the prior art that will be described. Even though these innovations may be suitable for the specific individual purposes to which they address, however, they differ from the present invention.

FOR EXAMPLE, U.S. Pat. No. 4,575,092 to Watson teaches an apparatus for dispensing balls, for example, golf or tennis balls, comprising a magazine, which can be mounted to extend downwardly to receive a plurality of balls to be dispensed from the lower end thereof, a ball-dispensing structure having a first condition in which the lowermost ball is restrained in the magazine and a second condition in which the lowermost ball is released and another ball is restrained in the magazine. The ball-dispensing structure thereby being operable by change between its two conditions to dispense at least the lowermost ball while restraining at least one other ball in the magazine.

ANOTHER EXAMPLE, U.S. Pat. No. 4,676,397 to Hoffmeister teaches a device used by an individual on a practice tee or similar device for the convenient placement of golf balls on a practice tee and the retrieval or pick-up of balls on and around a practice tee. The device allows for ease in carrying and is free-standing. The device allows for the storage of multiple golf balls due to the utilization of three metal tubes in which golf balls are placed. By pressing a lever, a golf ball is released from storage to the lower horizontal portion of the device which is rounded and cut out in front to allow for the placement of the ball on a tee from above and the removal of the device from the tee by lowering the device thereby placing the ball on the tee and sliding the device away from the tee. Conversely, the device can also be used for the pick up of a single ball and placement on a tee thereby reducing the necessity of a golfer to bend over and pick up a ball.

STILL ANOTHER EXAMPLE, U.S. Pat. No. 4,927,052 to Marthaler et al. teaches a golf ball package, holder and dispenser with a cylindrical plastic molder base or sleeve, a replaceable plastic cover, and a deformable hole in the base side. The base is a one-piece molding and the aperture is formed with an elliptical shape in the molding without additional parts.

YET ANOTHER EXAMPLE, U.S. Pat. No. 5,147,101 to Tiller teaches a golf ball dispensing and retrieval system that comprises a hollow tube for holding a plurality of golf balls. A stop mechanism is removably attachable to the bottom end of the tube for dispensing balls one at a time. The stop mechanism includes a biased lever which is pivotally attached to the outside of the tube movable between an open position and a closed position. To dispense golf balls from the tube, the lever may be moved by depressing a trigger end to an open position in which the detent is lifted away from the end of the tube to allow passage of the balls. Balls may be picked up from a surface by pressing the end of the tube and detent down onto a golf ball, which moves the detent out of the way to allow entry of a ball into the end of the tube. The lever is biased to be normally closed so that the balls remain inside the tube as desired. A stop pin is attached to the lever to prevent release of more than one ball at a time. A stand is also included to incline the tube so that as each ball is released, it rolls out of the tube for putting by the user thereof.

STILL YET ANOTHER EXAMPLE, U.S. Pat. No. 5,183,154 to Slemp teaches a golf ball holder which is simplified so that no auxiliary springs, gates or the like are necessary to hold the balls in place, and so that simple manipulation of the ball makes insertion and ejection possible. The device uses the deformality of the material at the ball opening to detain the ball. An opening opposite the ball opening provides access so that the ball can be pushed from the holder.

FINALLY, YET STILL ANOTHER EXAMPLE, U.S. Pat. No. 5,554,077 to Coles teaches a ball dispenser that is formed by a cylindrical housing or tube with a piston slidable therein and biased to a dispensing end of the tube. A cap is connected by a bridging member to the tube and projects over the axial center line of the cylinder and is formed with a concave spherical shape to receive the end of a ball contained within the dispenser. The dispenser is symmetrical on opposite sides of a central plane and an assess opening or mouth is provided adjacent to the cap through the side of the tube opposite the bridging section. The mouth is symmetrical on opposite sides of the plane and has its maximum opening at the central plane. The periphery of the mouth is defined by substantially V-shaped sides on each side of the plane with the bottom of the V shapes adjacent to the bridging section. The front edge or lip of the cap, i.e. at the plane overlying the mouth is closer to the cylindrical axis than the spherical radius of the ball to be dispensed so that the ball may be retained in the cap by the spring pressure on the piston and yet be easily withdrawn therefrom through the mouth or balls may be slid through the mouth with a rotating around the front lip of the cap.

It is apparent that numerous innovations for ball dispensers have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a dispenser and retriever for golf balls that avoids the disadvantages of the prior art.

ANOTHER OBJECT of the present invention is to provide a dispenser and retriever for golf balls that is simple and inexpensive to manufacture.

STILL ANOTHER OBJECT of the present invention is to provide a dispenser and retriever for golf balls that is simple to use.

BRIEFLY STATED, YET ANOTHER OBJECT of the present invention is to provide a dispenser and retriever for golf balls that includes a leg, a foot, ball-dispensing apparatus, and ball-retrieving apparatus. The leg is hollow and holds the golf balls and is generally inclined relative to the ground so as to allow the golf balls to be biased downwardly therein. The foot is hollow and communicates with the leg and dispenses the golf balls held in the leg and is inclined relative to the leg to lie substantially flat on the ground so as to allow the golf balls to exit therefrom, onto the ground. The ball-dispensing apparatus is operatively connected to the foot and selectively dispenses the golf balls, one at a time, from the foot, by use of a golf club, and without use of a foot of a user and without the user having to bend down. The ball-retrieving apparatus is operatively connected to the leg and selectively picks up the golf balls already on the ground.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
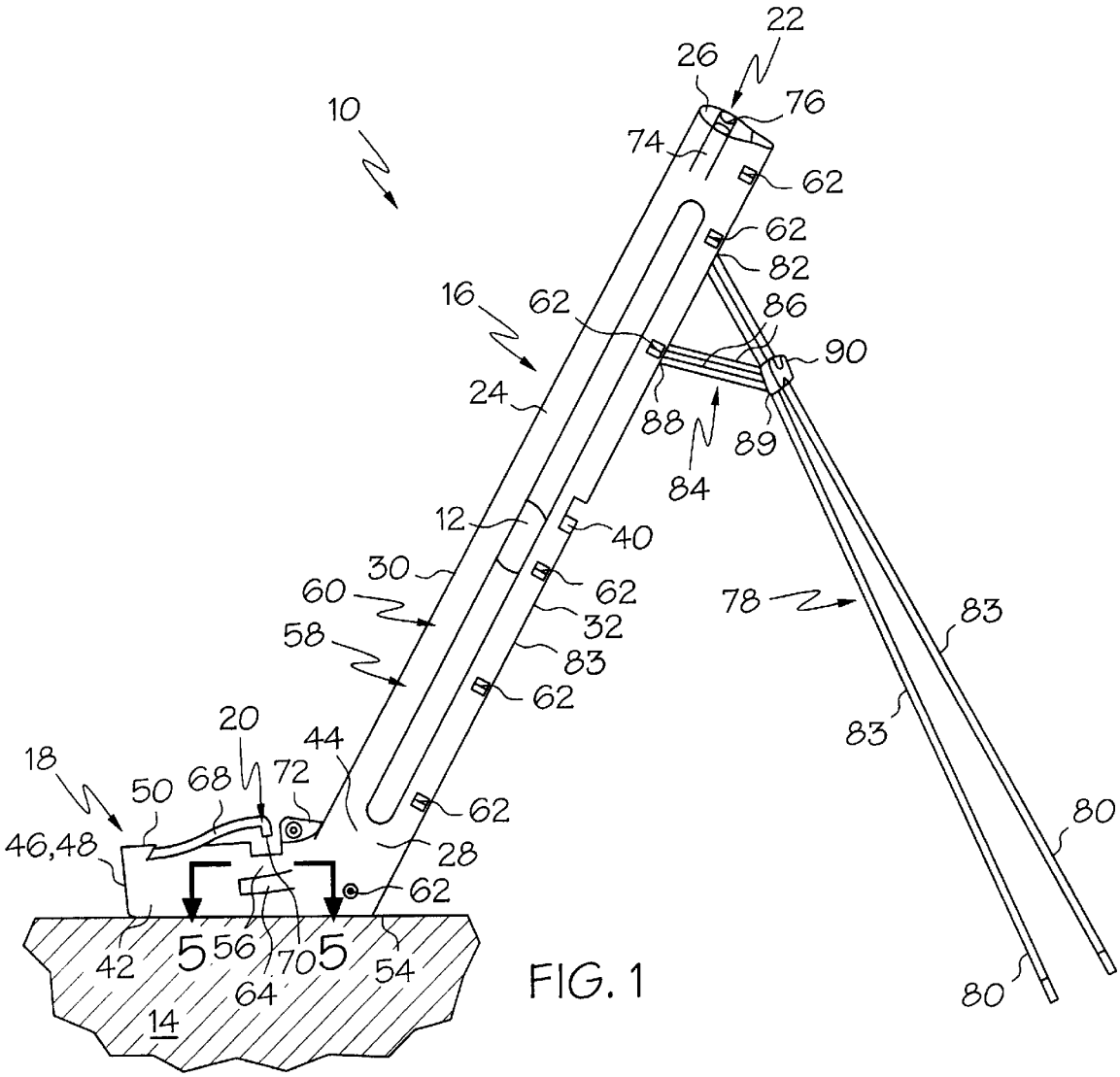
FIG. 1 is a diagrammatic side perspective view of the present invention in the in-use mode.
Figure 6:
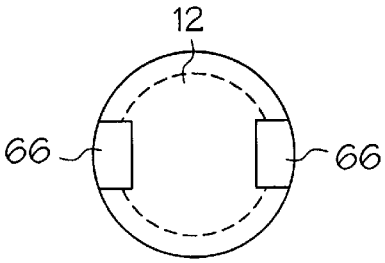
FIG. 6 is a diagrammatic front elevational view taken generally in the direction of ARROW 6 in FIG. 5.

10 dispenser and retriever for golf balls of the present invention
12 golf balls
14 ground
16 leg for holding golf balls 12
18 foot for dispensing golf balls 12 held in leg 16 and for lying substantially flat on ground 14
20 ball-dispensing apparatus for selectively dispensing golf balls 12, one at a time, from foot 18, by use of golf club, and without use of foot of user and without user having to bend down
22 ball-retrieving apparatus for selectively picking up golf balls 12 already on ground 14
24 ball-viewing side walls of leg 16 for viewing golf balls 12 held in leg 16
26 ball-feeding uppermost terminal end of leg 16 for feeding golf balls 12 into leg 16
28 lowermost terminal end of leg 16
30 front wall of leg 16
32 rear wall of leg 16
34 stand-storing recess in rear wall 32 of leg 16
36 uppermost wall defining stand-storing recess 34 in rear wall 32 of leg 16
38 lowermost wall further defining stand-storing recess 34 in rear wall 32 of leg 16
40 stand-storing notch in rear wall 32 of leg 16
42 side walls of foot 18
44 uppermost terminal end of foot 18
46 ball-exiting lowermost terminal end of foot 18 defining mouth 48 for exiting of golf balls 12
48 mouth of foot 18 for exiting of golf balls 12
50 top wall 50 of foot 18
52 juncture
54 ground-contacting bottom wall of foot 18
56 ball-dispensing notch in top wall 50 of foot 18
58 housing formed by leg 16 and foot 18
60 pair of halves of housing 58
62 screws holding together pair of halves 60 of housing 58 for ease of manufacture
64 pair of ball-restraining aligned ears of ball-dispensing apparatus 20
66 ball-grabbing inward hooks of pair of ball-restraining aligned ears 64 of ball-dispensing apparatus 20 for normally preventing golf balls 12 from exiting mouth 48 of foot 18
68 ball-dispensing lever of ball-dispensing apparatus 20
70 ball-release depending hook of ball-dispensing lever 68 of ball-dispensing apparatus 20
72 golfer-foot-stop of ball-dispensing apparatus 20
74 pair of ball-retrieving aligned ears of ball-retrieving apparatus 22
76 ball-grabbing inward hooks of pair of ball-retrieving aligned ears 74 of ball-retrieving apparatus 22 for normally preventing golf balls 12 from exiting ball-feeding uppermost terminal end 26 of leg 16
78 stand
80 pair of legs of stand 78
82 stand-pivoting uppermost terminal ends of pair of legs 80 of stand 78
83 tripod
84 leg maintainer of stand 78
86 pair of legs of leg maintainer 84 of stand 78

88 leg-pivoting lowermost terminal ends of pair of legs 86 of leg maintainer 84 of stand 78

89 leg-sliding uppermost terminal ends of pair of legs 86 of leg maintainer 84 of stand 78

90 coupling of leg maintainer 84 of stand 78

DETAILED DESCRIPTION OF THE PREFERRED EMBODIMENT

Figure 5:
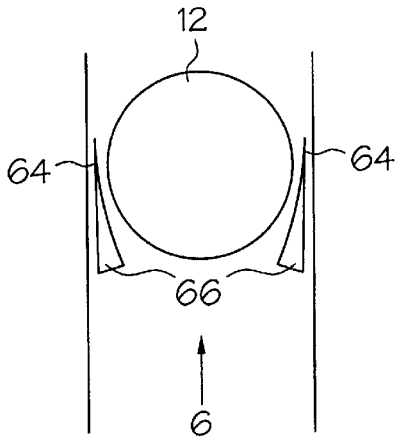
FIG. 5 is a diagrammatic top plan view taken generally on LINE 5—5 in FIG. 1.
Figure 2:
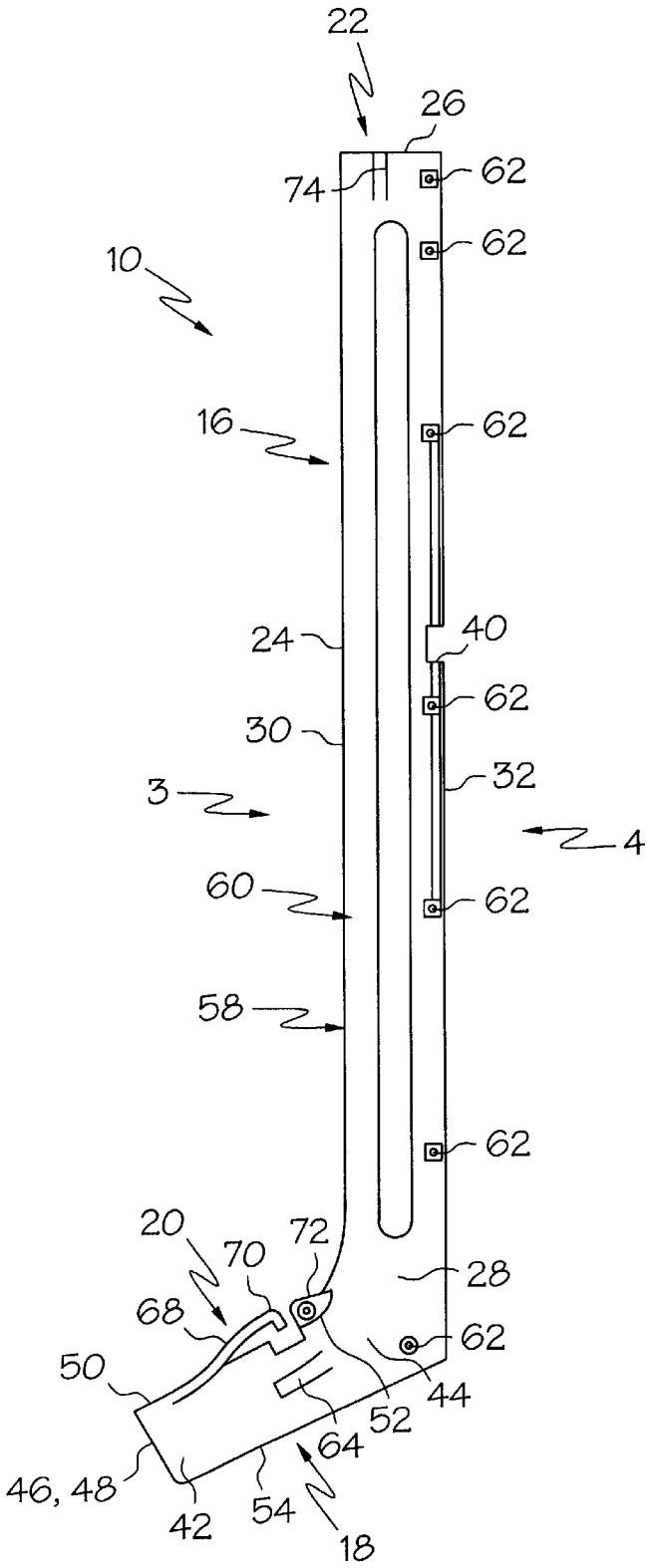
FIG. 2 is a diagrammatic side elevational view of the present invention in the collapsed mode.
Figure 3:
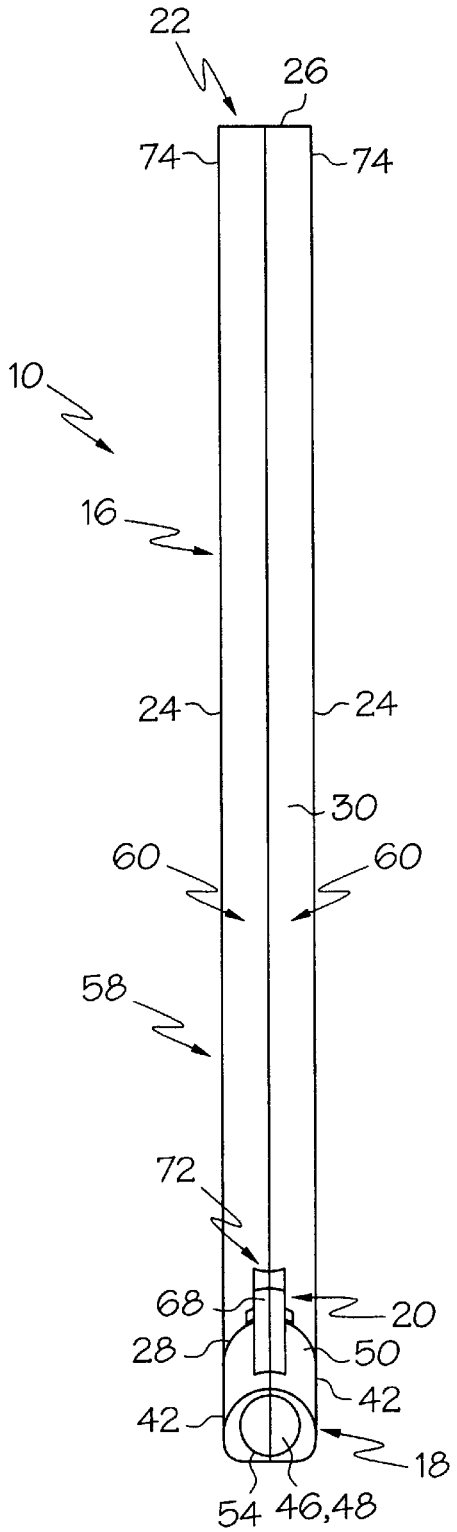
FIG. 3 is a diagrammatic front elevational view taken generally in the direction of ARROW 3 in FIG. 2.
Figure 4:
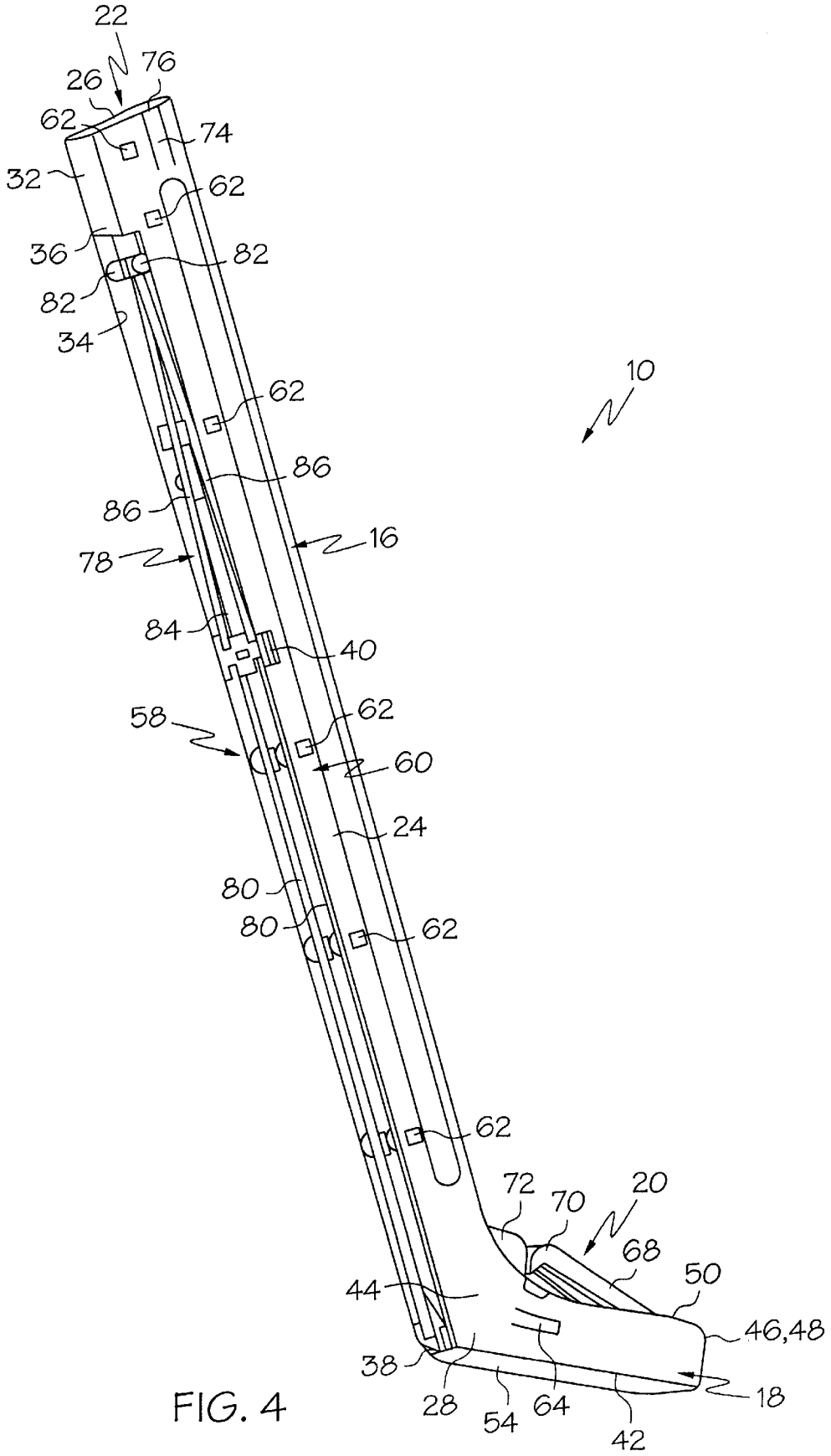
FIG. 4 is a diagrammatic rear prospective view taken generally in the direction of ARROW 4 in FIG. 2.

Referring now to the figures, in which like numerals indicate like parts, and particularly to FIGS. 1–6, which are, respectively, a diagrammatic side perspective view of the present invention in the in-use mode, a diagrammatic side elevational view of the present invention in the collapsed mode, a diagrammatic front elevational view taken generally in the direction of ARROW 3 in FIG. 2, a diagrammatic rear prospective view taken generally in the direction of ARROW 4 in FIG. 2, a diagrammatic top plan view taken generally on LINE 5—5 in FIG. 1, and a diagrammatic front elevational view taken generally in the direction of ARROW 6 in FIG. 5, the dispenser and retriever for golf balls of the present invention is shown generally at 10 for golf balls 12 with diameters and for resting on the ground 14.

The dispenser and retriever for golf balls 10 comprises a leg 16 being hollow for holding the golf balls 12 and being generally inclined relative to the ground 14 so as to allow the golf balls 12 to be biased downwardly therein.

The dispenser and retriever for golf balls 10 further comprises a foot 18 being hollow and communicating with the leg 16 for dispensing the golf balls 12 held in the leg 16, and being inclined relative to the leg 16 for lying substantially flat on the ground 14 so as to allow the golf balls 12 to exit therefrom, onto the ground 14.

The dispenser and retriever for golf balls 10 further comprises ball-dispensing apparatus 20 operatively connected to the foot 18 for selectively dispensing the golf balls 12, one at a time, from the foot 18, by use of a golf club, and without use of a foot of a user and without the user having to bend down.

The dispenser and retriever for golf balls 10 further comprises ball-retrieving apparatus 22 operatively connected to the leg 16 for selectively picking up the golf balls 12 already on the ground 14.

The leg 16 is elongated, slender, and tubular, and has ball-viewing side walls 24 that are substantially open for viewing the golf balls 12 held therein, a ball-feeding uppermost terminal end 26 that is opened for feeding the golf balls 12 into the leg 16, a lowermost terminal end 28 from which the foot 18 extends, a front wall 30, and a rear wall 32 with a length that has a stand-storing recess 34 therein that extends longitudinally along substantially the length of the rear wall 32 of the leg 16.

The stand-storing recess 34 in the rear wall 32 of the leg 16 is continuous and is defined by an uppermost wall 36 that is disposed slightly below the ball-feeding uppermost terminal end 26 of the leg 16 and a lowermost wall 38 that is disposed at the foot 18.

The rear wall 32 of the leg 16 further has a stand-storing notch 40 that extends laterally thereacross and which opens into the stand-storing recess 34 in the rear wall 32 of the leg 16.

The stand-storing notch 40 in the rear wall 32 of the leg 16 is disposed substantially midway between the uppermost wall 36 and the lowermost wall 38 of the stand-storing recess 34 in the rear wall 32 of the leg 16.

The foot 18 is elongated, slender, and tubular, and has side walls 42 that extend continuously forwardly from, and are inclined downwardly relative to, the ball-viewing side walls 24 of the leg 16, an uppermost terminal end 44 that communicates with the lowermost terminal end 28 of the leg 16, a ball-exiting lowermost terminal end 46 that defines a mouth 48 for exiting of the golf balls 12, a top wall 50 that extends continuously forwardly from, and is inclined downwardly relative to, the front wall 30 of the leg 16, at a juncture 52, and a ground-contacting bottom wall 54 that extends continuously forwardly from, and is inclined downwardly relative to, the rear wall 32 of the leg 16.

The top wall 50 of the foot 18 has a ball-dispensing notch 56 that extends laterally thereacross, slightly forwardly from the juncture 52 of the front wall 30 of the leg 16 and the top wall 50 of the foot 18, and which opens dependingly slightly into the side walls 42 of the foot 18.

The leg 16 and the foot 18 form a housing 58 that is slender, elongated, and tubular, and comprises a pair of halves 60 that are mirror images of each other for ease of molding and held together by screws 62 for ease of manufacture.

The ball-dispensing apparatus 20 comprises a pair of ball-restraining aligned ears 64 that extend resiliently forwardly from the side walls 42 of the foot 18, respectively, and terminate in ball-grabbing inward hooks 66 that are disposed slightly forwardly from the ball-dispensing notch 56 in the top wall 50 of the foot 18 for normally preventing the golf balls 12 from exiting the mouth 48 of the foot 18.

The ball-grabbing inward hooks 66 of the pair of ball-restraining aligned ears 64 of the ball-dispensing apparatus 20 are disposed forwardly from the ball-dispensing notch 56 in the top wall 50 of the foot 18, a distance that is slightly more than one half the diameter of one golf ball 12.

The pair of ball-restraining aligned ears 64 of the ball-dispensing apparatus 20 are stamped, on three sides, out of the side walls 42 of the foot 18 for ease of manufacture, bent inwardly, and thinned to be more resilient than the side walls 42 of the foot 18 so as to prevent deformation of the side walls 42 of the foot 18 when the pair of ball-restraining aligned ears 64 of the ball-dispensing apparatus 20 deflect.

The ball-dispensing apparatus 20 further comprises a ball-dispensing lever 68 that extends resiliently rearwardly upwardly from the top wall 50 of the foot 18, and terminates in a ball-release depending hook 70 that is normally disposed above the ball-dispensing notch 56 in the top wall 50 of the foot 18, and when the ball-dispensing lever 68 of the ball-dispensing apparatus 20 is pressed down by a golf club and the ball-release depending hook 70 of the ball-dispensing lever 68 of the ball-dispensing apparatus 20 enters into the ball-dispensing notch 56 in the top wall 50 of the foot 18 and contacts the golf ball 12 retained by the ball-grabbing inward hooks 66 of the pair of ball-restraining aligned ears 64 of the ball-dispensing apparatus 20, the golf ball 12 is forced forwardly against biasing of the pair of ball-restraining ears 64 of the ball-dispensing apparatus 20 which deflects the pair of ball-restraining ears 64 of the ball-dispensing apparatus 20 outwardly for allowing the golf ball 12 to discharge through the mouth 48 of the foot 18, and onto the ground 14, with the pair of ball-restraining ears 64 of the ball-dispensing apparatus 20 then deflecting back inwardly for preventing a next golf ball 12 from undesirable exit through the mouth 48 of the foot 18, until the ball-dispensing lever 68 of the ball-dispensing apparatus 20 is again pressed by the golf club.

The ball-dispensing lever 68 of the ball-dispensing apparatus 20 is stamped, on three sides, out of the top wall 50 of the foot 18 for ease of manufacture, bent upwardly, and thinned to be more resilient that the top wall 50 of the foot 18 so as to prevent deformation of the top wall 50 of the foot 18 when the ball-dispensing lever 68 of the ball-dispensing apparatus 20 deflects.

The ball-dispensing apparatus 20 further comprises a golfer-foot-stop 72 that extends upwardly from the juncture 52 of the front wall 30 of the leg 16 and the top wall 50 of the foot 18, to a height slightly greater than that of the ball-dispensing lever 68 of the ball-dispensing apparatus 20 for preventing the ball-dispensing lever 68 of the ball-dispensing apparatus 20 from being inadvertently stepped on by a foot of a user.

The ball-retrieving apparatus 22 comprises a pair of ball-retrieving aligned ears 74 that extend resiliently upwardly from the ball-viewing side walls 24 of the leg 16, respectively, and terminate in ball-grabbing inward hooks 76 that are disposed at, and communicate directly with, the ball-feeding uppermost terminal end 26 of the leg 16 for normally preventing the golf balls 12 from exiting the ball-feeding uppermost terminal end 26 of the leg 16, and when the leg 16 is turned up-side-down, and the ball-retrieving uppermost terminal end 26 of the leg 16 is placed over, and forced onto, the golf ball 12 on the ground 14, the golf ball 12 forces the ball-grabbing inward hooks 76 of the pair of ball-retrieving aligned ears 74 of the ball-retrieving apparatus 22 to deflect outwardly for allowing the golf ball 12 to pass through the ball-retrieving uppermost terminal end 26 of the leg 16 and into the leg 16, with the pair of ball-retrieving ears 74 of the ball-retrieving apparatus 22 then deflecting back inwardly for preventing the golf ball 12 from undesirable exit through the ball-retrieving uppermost terminal end 26 of the leg 16.

The pair of ball-restraining aligned ears 74 of the ball-dispensing apparatus 22 are stamped, on two sides, out of the ball-viewing side walls 24 of the leg 16 for ease of manufacture, bent inwardly, and thinned to be more resilient than the ball-viewing side walls 24 of the leg 16 so as to prevent deformation of the ball-viewing side walls 24 of the leg 16 when the pair of ball-retrieving aligned ears 74 of the ball-retrieving apparatus 22 deflect.

The dispenser and retriever for golf balls 10 further comprises a stand 78 pivotally mounted in the stand-storing recess 34 in the rear wall 32 of the leg 16.

The stand 78 has a collapsed mode and in-use mode and comprises a pair of legs 80 that have stand-pivoting uppermost terminal ends 82 pivotally mounted to the uppermost terminal wall 36 of the stand-storing recess 34 in the rear wall 32 of the leg 16, and when the stand 78 is in the collapsed mode, the pair of legs 80 of the stand 78 are recessed into the stand-storing recess 34 in the rear wall 32 of the leg 16, and when the stand 78 is in the in-use mode, the pair of legs 80 of the stand 78 are pivoted outwardly from their stand-pivoting uppermost terminal ends 82, and together with the housing 58, form a tripod 83.

The stand 78 further comprises a leg maintainer 84 that maintains the pair of legs 80 of the stand 78 in one of the collapsed mode thereof and the in-use mode thereof.

The leg maintainer 84 of the stand 78 comprises a pair of legs 86 that have leg-pivoting lowermost terminal ends 88 that are pivotally mounted to the stand-storing recess 34 in the rear wall 32 of the leg 16, substantially midway between the stand-storing notch 40 in the rear wall 32 of the leg 16 and the uppermost terminal wall 36 of the stand-storing recess 34 in the rear wall 32 of the leg 16, and leg-sliding uppermost terminal ends 89 that are slidably mounted to the pair of legs 80 of the stand 78, by a coupling 90, and when the stand 78 is achieving its collapsed mode, the coupling 90 of the leg maintainer 84 of the stand 78 slides down the pair of the legs 80 of the stand 78 and into the stand-storing notch 40 in the rear wall 32 of the leg 16, and when the stand 78 is achieving its in-use mode, the coupling 90 of the leg maintainer 84 of the stand 78 slides out of the stand-storing notch 40 in the rear wall 32 of the leg 16 and up the pair of legs 80 of the stand 78.

It will be understood that each of the elements described above, or two or more together, may also find a useful application in other types of constructions differing from the types described above.

While the invention has been illustrated and described as embodied in a dispenser and retriever for golf ball, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A dispenser and retriever for golf balls with diameters and for resting on the ground, comprising:

a) a leg being hollow for holding the golf balls and being generally inclined relative to the ground so as to allow the golf balls to be biased downwardly therein; said leg having:

i) ball-viewing side walls being substantially open for viewing the golf balls held therein;

ii) a ball-feeding uppermost terminal end being opened for feeding the golf balls into said leg;

iii) a lowermost terminal end from which a foot extends;

iv) a front wall; and v) a rear wall with a length having a stand-storing recess therein extending longitudinally along substantially said length of said rear wall of said leg;

b) said foot being hollow and communicating with said leg for dispensing the golf balls held in said leg and being inclined relative to said leg for lying substantially flat on the ground so as to allow the golf balls to exit therefrom, onto the ground;

c) ball-dispensing apparatus operatively connected to said foot for selectively dispensing the golf balls, one at a time, from said foot, by use of a golf club, and without use of a foot of a user and without the user having to bend down; and d) ball-retrieving apparatus operatively connected to said leg for selectively picking up the golf balls already on the ground.

2. The dispenser as defined in claim 1, wherein said leg is elongated, slender, and tubular.

3. The dispenser as defined in claim 1, wherein said stand-storing recess in said rear wall of said leg is continuous and is defined by:

a) an uppermost wall that is disposed slightly below said ball-feeding uppermost terminal end of said leg; and b) a lowermost wall that is disposed at said foot.

4. The dispenser as defined in claim 3, wherein said rear wall of said leg further has a stand-storing notch that extends laterally thereacross and which opens into said stand-storing recess in said rear wall of said leg.

5. The dispenser as defined in claim 4, wherein said stand-storing notch in said rear wall of said leg is disposed substantially midway between said uppermost wall and said lowermost wall of said stand-storing recess in said rear wall of said leg.

6. The dispenser as defined in claim 4; further comprising a stand pivotally mounted in said stand-storing recess in said rear wall of said leg.

7. The dispenser as defined in claim 6, wherein said stand has a collapsed mode and in-use mode and comprises a pair of legs that have stand-pivoting uppermost terminal ends pivotally mounted to said uppermost terminal wall of said stand-storing recess in said rear wall of said leg, and when said stand is in said collapsed mode, said pair of legs of said stand are recessed into said stand-storing recess in said rear wall of said leg, and when said stand is in said in-use mode, said pair of legs of said stand are pivoted outwardly from their stand-pivoting uppermost terminal ends, and together with said housing, form a tripod.

8. The dispenser as defined in claim 7, wherein said stand further comprises a leg maintainer that maintains said pair of legs of said stand in one of said collapsed mode thereof and said in-use mode thereof.

9. The dispenser as defined in claim 8, wherein said leg maintainer of said stand comprises a pair of legs that have:

a) leg-pivoting lowermost terminal ends that are pivotally mounted to said stand-storing recess in said rear wall of said leg, substantially midway between said stand-storing notch in said rear wall of said leg and said uppermost terminal wall of said stand-storing recess in said rear wall of said leg; and b) leg-sliding uppermost terminal ends that are slidably mounted to said pair of legs of said stand, by a coupling, and when said stand is achieving its collapsed mode, said coupling of said leg maintainer of said stand slides down said pair of said legs of said stand and into said stand-storing notch in said rear wall of said leg, and when said stand is achieving its in-use mode, said coupling of said leg maintainer of said stand slides out of said stand-storing notch in said rear wall of said leg and up said pair of legs of said stand.

10. The dispenser as defined in claim 3, wherein said foot has side walls that extend continuously forwardly from, and are inclined downwardly relative to, said ball-viewing side walls of said leg.

11. The dispenser as defined in claim 10, wherein said foot further has:

a) an uppermost terminal end that communicates with said lowermost terminal end of said leg; and b) a ball-exiting lowermost terminal end that defines a mouth for exiting of the golf balls.

12. The dispenser as defined in claim 11, wherein said foot further has:

a) a top wall that extends continuously forwardly from, and is inclined downwardly relative to, said front wall of said leg, at a juncture; and b) a ground-contacting bottom wall that extends continuously forwardly from, and is inclined downwardly relative to, said rear wall of said leg.

13. The dispenser as defined in claim 12, wherein said top wall of said foot has a ball-dispensing notch that extends laterally thereacross, slightly forwardly from said juncture of said front wall of said leg and said top wall of said foot, and which opens dependingly slightly into said side walls of said foot.

14. The dispenser as defined in claim 13, wherein said ball-dispensing apparatus comprises a pair of ball-restraining aligned ears that extend resiliently forwardly from said side walls of said foot, respectively, and terminate in ball-grabbing inward hooks that are disposed slightly forwardly from said ball-dispensing notch in said top wall of said foot for normally preventing the golf balls from exiting said mouth of said foot.

15. The dispenser as defined in claim 14, wherein said ball-grabbing inward hooks of said pair of ball-restraining aligned ears of said ball-dispensing apparatus are disposed forwardly from said ball-dispensing notch in said top wall of said foot, a distance that is slightly more than one half the diameter of one golf ball.

16. The dispenser as defined in claim 14, wherein said pair of ball-restraining aligned ears of said ball-dispensing apparatus are stamped, on three sides, out of said side walls of said foot for ease of manufacture, bent inwardly, and thinned to be more resilient than said side walls of said foot so as to prevent deformation of said side walls of said foot when said pair of ball-restraining aligned ears of said ball-dispensing apparatus deflect.

17. The dispenser as defined in claim 14, wherein said ball-dispensing apparatus further comprises a ball-dispensing lever that extends resiliently rearwardly upwardly from said top wall of said foot, and terminates in a ball-release depending hook that is normally disposed above said ball-dispensing notch in said top wall of said foot, and when said ball-dispensing lever of said ball-dispensing apparatus is pressed down by a golf club and said ball-release depending hook of said ball-dispensing lever of said ball-dispensing apparatus enters into said ball-dispensing notch in said top wall of said foot and contacts the golf ball retained by said ball-grabbing inward hooks of said pair of ball-restraining aligned ears of said ball-dispensing apparatus, the golf ball is forced forwardly against biasing of said pair of ball-restraining ears of said ball-dispensing apparatus which deflects said pair of ball-restraining ears of said ball-dispensing apparatus outwardly for allowing the golf ball to discharge through said mouth of said foot, and onto the ground, with said pair of ball-restraining ears of said ball-dispensing apparatus then deflecting back inwardly for preventing a next golf ball from undesirable exit through said mouth of said foot, until said ball-dispensing lever of said ball-dispensing apparatus is again pressed by the golf club.

18. The dispenser as defined in claim 17, wherein said ball-dispensing lever of said ball-dispensing apparatus is stamped, on three sides, out of said top wall of said foot for ease of manufacture, bent upwardly, and thinned to be more resilient that said top wall of said foot so as to prevent deformation of said top wall of said foot when said ball-dispensing lever of said ball-dispensing apparatus deflects.

19. The dispenser as defined in claim 17, wherein said ball-dispensing apparatus further comprises a golfer-foot-stop that extends upwardly from said juncture of said front wall of said leg and said top wall of said foot, to a height slightly greater than that of said ball-dispensing lever of said ball-dispensing apparatus for preventing said ball-dispensing lever of said ball-dispensing apparatus from being inadvertently stepped on by a foot of a user.

20. The dispenser as defined in claim 1, wherein said foot is elongated, slender, and tubular.

21. The dispenser as defined in claim 1, wherein said leg and said foot form a housing.

22. The dispenser as defined in claim 21, wherein said housing is slender, elongated, and tubular.

23. The dispenser as defined in claim 21, wherein said housing comprises a pair of halves that are mirror images of each other for ease of molding.

24. The dispenser as defined in claim 23, wherein said pair of halves of said housing are held together by screws for ease of manufacture.

25. The dispenser as defined in claim 1, wherein said ball-retrieving apparatus comprises a pair of ball-retrieving aligned ears that extend resiliently upwardly from said ball-viewing side walls of said leg, respectively, and terminate in ball-grabbing inward hooks that are disposed at, and communicate directly with, said ball-feeding uppermost terminal end of said leg for normally preventing the golf balls from exiting said ball-feeding uppermost terminal end of said leg, and when said leg is turned up-side-down, and said ball-retrieving uppermost terminal end of said leg is placed over, and forced onto, the golf ball on the ground, the golf ball forces said ball-grabbing inward hooks of said pair of ball-retrieving aligned ears of said ball-retrieving apparatus to deflect outwardly for allowing the golf ball to pass through said ball-retrieving uppermost terminal end of said leg, and into said leg, with said pair of ball-retrieving ears of said ball-retrieving apparatus then deflecting back inwardly for preventing the golf ball from undesirable exit through said ball-retrieving uppermost terminal end of said leg.

26. The dispenser as defined in claim 25, wherein said pair of ball-retrieving aligned ears of said ball-dispensing apparatus are stamped, on two sides, out of said ball-viewing side walls of said leg for ease of manufacture, bent inwardly, and thinned to be more resilient than said ball-viewing side walls of said leg so as to prevent deformation of said ball-viewing side walls of said leg when said pair of ball-retrieving aligned ears of said ball-retrieving apparatus deflect.

* * * * *